US006817956B1

(12) United States Patent
Dagenais

(10) Patent No.: US 6,817,956 B1
(45) Date of Patent: Nov. 16, 2004

(54) GOLF CLUB GRIP

(76) Inventor: Kim Dagenais, 345 Oakwood, Clarklake, MI (US) 40234

( * ) Notice: Subject to any disclaimer, the term of this patent is extended or adjusted under 35 U.S.C. 154(b) by 0 days.

(21) Appl. No.: 10/447,372

(22) Filed: May 29, 2003

Related U.S. Application Data

(60) Provisional application No. 60/388,687, filed on Jun. 14, 2002.

(51) Int. Cl.[7] ..... A63B 53/14

(52) U.S. Cl. ..... 473/300; 473/294

(58) Field of Search ..... 473/294, 296, 473/298, 300–303; D21/756

(56) References Cited

U.S. PATENT DOCUMENTS

| | | | | |
|---|---|---|---|---|
| 3,173,689 | A | | 3/1965 | Serblin |
| 3,295,850 | A | | 1/1967 | Garrity |
| 3,614,101 | A | | 10/1971 | Hunter |
| 3,809,403 | A | | 5/1974 | Hunter |
| 4,116,440 | A | | 9/1978 | Takeshima |
| 4,163,554 | A | | 8/1979 | Bernhardt |
| 4,272,077 | A | | 6/1981 | Spivey |
| 4,597,578 | A | | 7/1986 | Lancaster |
| 4,746,120 | A | | 5/1988 | Mockovak |
| 4,974,846 | A | | 12/1990 | Fenton |
| 4,979,743 | A | * | 12/1990 | Sears ..... 473/204 |
| 5,261,665 | A | | 11/1993 | Downey |
| 5,322,290 | A | | 6/1994 | Minami |
| 5,348,303 | A | | 9/1994 | Swissheim |
| 5,460,372 | A | | 10/1995 | Cook |
| 5,511,790 | A | | 4/1996 | Duran |
| 5,524,885 | A | | 6/1996 | Heo |
| 5,569,098 | A | | 10/1996 | Klein |
| 5,575,473 | A | | 11/1996 | Turner |
| 5,626,527 | A | | 5/1997 | Eberlein |
| 5,681,226 | A | | 10/1997 | Chambers, Jr. |
| 5,692,970 | A | | 12/1997 | Nelson |
| 5,775,756 | A | | 7/1998 | Rozenich |
| 5,779,559 | A | | 7/1998 | Eberle |
| 5,795,241 | A | | 8/1998 | Peshek |
| 5,800,283 | A | | 9/1998 | Nomura |
| 5,813,920 | A | | 9/1998 | Rife |
| 5,909,912 | A | | 6/1999 | Mueller |
| 6,213,890 | B1 | * | 4/2001 | Prince ..... 473/292 |
| 6,213,891 | B1 | | 4/2001 | Moore |
| 6,350,206 | B1 | | 2/2002 | Lambert, II |

* cited by examiner

*Primary Examiner*—Stephen Blau
(74) *Attorney, Agent, or Firm*—Honigman Miller Schwartz and Cohn LLP

(57) ABSTRACT

An improved golf club grip is provided that is comprised of a shaft, including an upper shaft portion; an upper grip portion positioned about at least a portion of the upper shaft portion; and a lower grip portion positioned below the upper grip portion. In an embodiment, the outer diameter of the upper grip portion is significantly less than the outer diameter of the lower grip portion.

19 Claims, 2 Drawing Sheets

FIG. 5
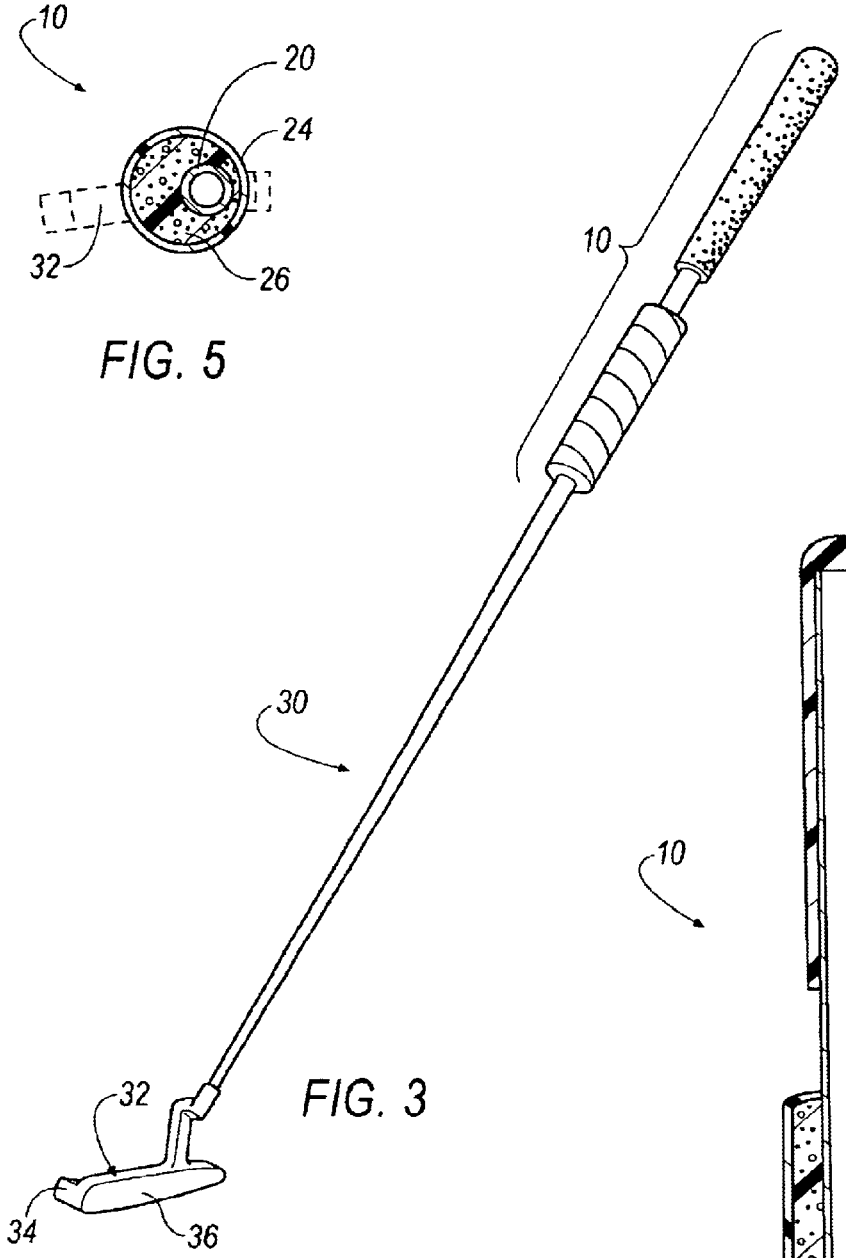
FIG. 3
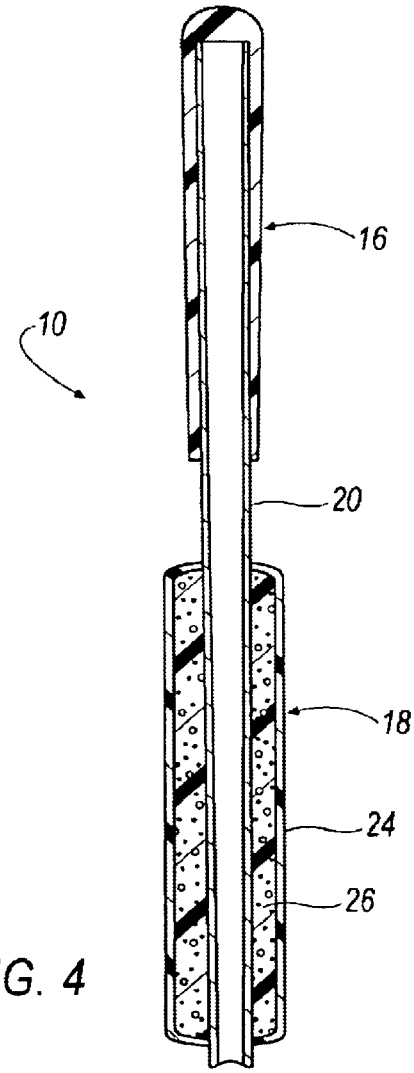
FIG. 4

GOLF CLUB GRIP

RELATED APPLICATIONS

This application claims priority to U.S. provisional patent application 60/388,687, filed on Jun. 14, 2002, which is incorporated herein by reference in its entirety.

BACKGROUND

1. Field of the Invention

The present invention relates to a golf club grip that can provide improved accuracy, especially for putting.

2. Description of the Related Art

A number of different types of conventional golf club grips arc known in the art. Such grips include a variety of extended, bulging, or split-grips that may be grasped by both hands of a user. However, such prior art club grips have a variety of limitations that are addressed by embodiments of the present invention. For example, without limitation, conventional dual-grip putters generally do not take into account the dominance of one hand positioned above the other relative to the rotational movement of the associated shaft and club head. Further, many conventional clubs are purely designed for training purposes, and consequently cannot readily conform to the regulations or requirements associated with "professional" (e.g., "USGA-accepted") equipment.

SUMMARY

An improved golf club grip is provided that is comprised of a shaft of a club (e.g., a putter), including an upper shaft portion; an upper grip portion positioned about at least a portion of the upper shaft portion; and a lower grip portion positioned below the upper grip portion. In an embodiment, the outer diameter of the upper grip portion is significantly less than the outer diameter of the lower grip portion.

BRIEF DESCRIPTION OF THE DRAWINGS

The features and inventive aspects of the present invention will become more apparent upon reading the following detailed description, claim and drawings, of which the following is a brief description:

FIG. 3 is a golf club shown to include an embodiment of the golf club grip of the present invention.

FIG. 4 is a vertical sectional view of an embodiment of the golf club grip of the present invention.

FIG. 5 is a horizontal sectional view of an embodiment of a golf club grip of the present invention.

DETAILED DESCRIPTION OF PREFERRED EMBODIMENTS

Figure 1:
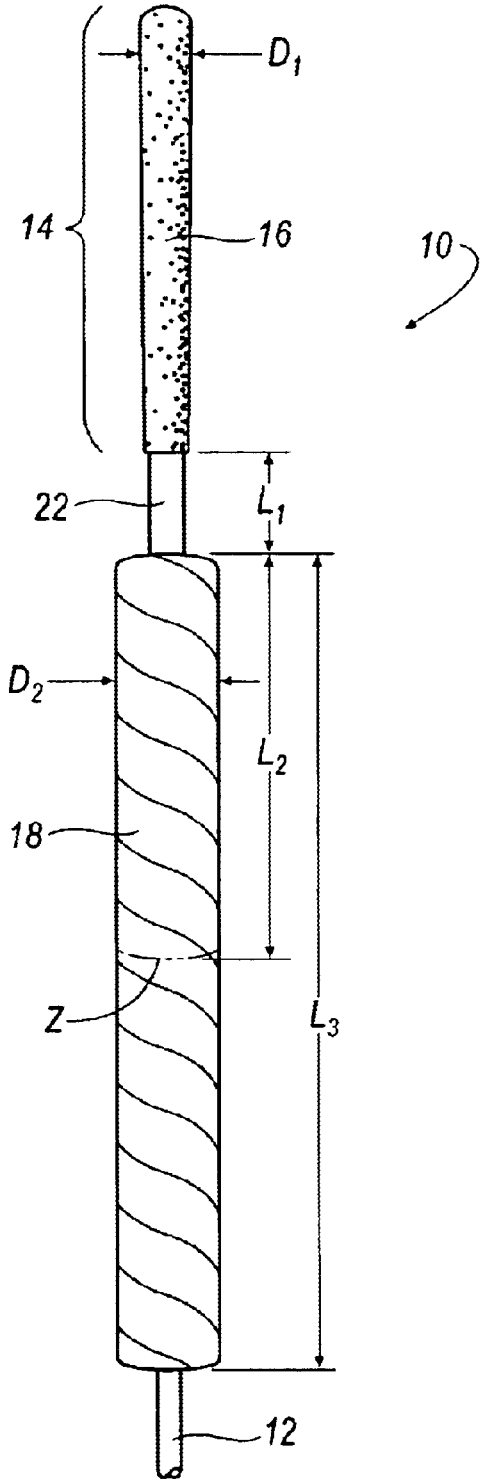
FIG. 1 is a front elevation view of a golf club grip according to an embodiment of the present invention.

Referring now to the drawings, several preferred embodiments of the present invention are described in detail.

A golf club grip 10 in accordance with an embodiment of the present invention is shown in FIG. 1. Club grip 10 includes a shaft 12, having an upper shaft portion 14; an upper grip portion 16; and a lower grip portion 18. In a preferred embodiment, such as that depicted, the upper grip portion 16 and lower grip portion are separated by a space or gap 22 along the shaft. Gap 20 includes a separation distance or length ($L_1$) interposed between the grip portions 16,18. However, it is important to note that many-variations of the invention are possible, including variations in which the gap 22 is expanded, reduced, or eliminated entirely, such as where the two grip portions 16,18 are formed in a unitary manner.

The upper shaft portion 14 is the upper vertical portion of the club shaft 12 as viewed when the associated club grip is in use—such as in the orientation illustrated in FIG. 1. Preferably, an upper grip portion 16 is positioned about (and covers) all or a substantial the entire portion of the upper shaft portion 14. In a preferred construction, the upper grip portion 16 is cylindrical or substantially cylindrical and has a conventional shaft length from about 5 inches to about 13 inches, and more preferably is the length of a conventional grip (i.e., about 6 inches). The upper grip portion may be conventionally constructed or formed from any materials used to form golf club grips.

Further, if desired, the upper grip portion 16 may be completely or partially tapered. For example, the grip portion 16 may include a portion or segment with an inward taper in the outer diameter of the grip portion down along the shaft (e.g., in the direction of a club head). Preferably, if a taper is included, the outer diameter will taper from about 1 inch to about ¾-inch. Conversely, if no taper is employed with the upper grip portion 16, the outer diameter of the upper grip portion 16 will preferably be within the range of about ¾-inch to about 1 inch.

The lower grip portion 18 is also preferably cylindrical or substantially cylindrical and has a shaft length that is generally designated by $L_2$ in FIG. 1. In a preferred embodiment, $L_2$ is approximately the same shaft length as the upper grip portion 16 and would be truncated at or near the reference line shown in FIG. 1 as marking Z. However, the invention is not so limited and, if desired, the length of the lower grip portion (as generally illustrated as $L_3$) can be extended significantly, i.e., to as much as two or more times the length of the upper grip portion.

The outer diameter of the lower grip portion is preferably within the range of about 1.5 inches to about 3 inches, with a preferred maximum outer diameter of 1.75 inches. As with the upper grip portion 16, the lower grip portion 18 may also be conventionally constructed or formed from any materials used to form golf club grips.

The lower grip portion 18 has a minimum (or, possibly an average) outer diameter, taken along its shaft length, that is generally designated by $D_2$. Similarly, the upper grip portion 16 also has a maximum (or, possibly an average) outer diameter, which is generally designated by $D_1$. Preferably, the relationship between $D_1$ and $D_2$ follows equations [1] and [2] below:

$$D_1 \leqq D_2 \times 0.5714 \quad [1]$$

$$D_2 \geqq D_1 / 0.5714 \quad [2]$$

As such, in a preferred embodiment of the invention, the maximum outer diameter of the upper grip portion 16 is less than or equal to about 57.14% of the minimum diameter of the lower grip portion 18. For example, when an upper club grip 16 has a diameter $D_1$ of 1 inch, following the general guidance of equation [2] above, diameter $D_2$ of the lower club grip is preferably greater than or equal to about 1.75 inches. Likewise, if upper club grip 16 has a ¾-inch diameter $D_1$, the diameter of the lower club grip $D_2$ preferably will be greater than or equal to about 1.31 inches.

Moreover, in a preferred embodiment, the minimum (or average) diameter of the lower grip portion 18 be at least (i)

twice the maximum (or average) diameter of the upper grip portion and/or (ii) will be at least ¾-inch larger than the maximum (or average) diameter of the upper grip portion 16. As used herein, the "maximum" diameter of the upper grip portion refers to the true grip portion of the handle that is intended for use as a gripping surface and not miscellaneous transition components. Further, where the term "average" is used parenthetically, the corresponding average outer diameter should also be employed.

As previously noted, in a preferred embodiment, an optional space or gap 20 may be included (as part of the shaft) between the upper and lower grip portions 16,18. While a gap of about 1½ inches is preferred, smaller and larger gaps may be used, as desired by the user or required to meet various regulations or standards.

Figure 2:
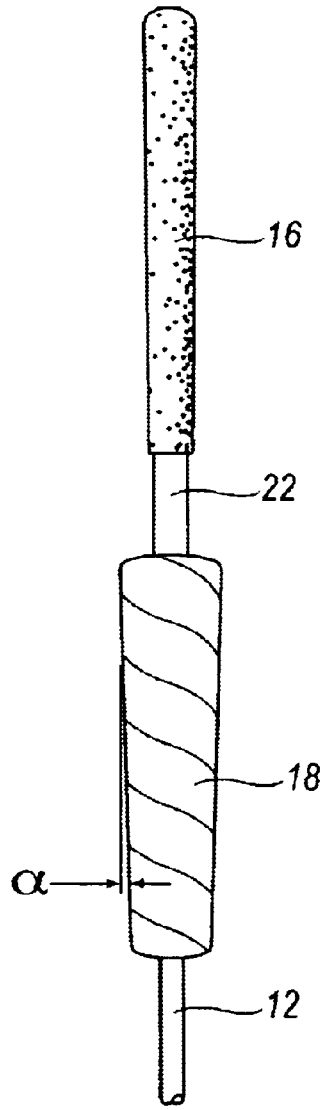
FIG. 2 is an elevation view of another embodiment of a golf club grip in accordance with the present invention.

If desired, the lower grip portion 18 may also be tapered. As illustrated in FIG. 2, a portion of grip portion 18 can be tapered inwardly along the length of the shaft (in the direction moving away from the upper grip portion 16). The amount of taper from the normal, generally indicated by angle (a) is preferably between about 3 to about 10 degrees.

A golf club 30, including a putter head 32 and a club grip 10 is generally shown in FIG. 3. If desired, the club—including the associated grip 10—can be configured to be within present or prospective USGA regulations, so as to be used on tour or otherwise by professional golfers.

FIG. 4 generally depicts a preferred embodiment of a club grip 10 as a cross sectional view taken vertically along the length of the shaft 20. As illustrated in the figure, the upper grip portion 16 can be fairly conventional and enclose the upper end of the shaft 20. In a preferred embodiment, lower grip portion 18 is comprised of at least two components: an outer contact material 24 and an inner filler material 26 that is in contact with the shaft 20. The outer contact material 24 is preferably a material that provides a good gripping surface for a user. The filler material 26 need not be comprised of the same materials as the contact material 24, but preferably will sufficiently retain the desired shape of the overall grip portion 18 while providing some degree of comfort or cushion for the user.

By providing gripping portions (16,18) with differing diameters, such as those specified above, a club grip 10 can be provided in which the lower grip portion 18 (gripped by the lower hand of a user) can "counter" or exert more control over the shot to better balance or compensate for the added rotational leverage typically exerted by the upper grip portion 16. Further, if the outer diameter of the lower grip portion 18 is substantially larger than the outer diameter of the upper grip portion, the lower grip portion (which is further typically gripped by the user's dominant hand) can exert more control (than a similarly-sized grip to the upper grip portion) and is less likely to turn the club head during the motion of the club stroke.

FIG. 5 is a cross-sectional view of a club grip 10 taken horizontally across a shaft through an embodiment of a lower grip 18 that indicates an optional configuration. Because of the differences in rotational leverage on the shaft 20 exerted by a user's hands on the upper and lower grip portions 16,18, if desired, the lower grip portion 18 may be positioned somewhat "offenter" with respect to the center of the shaft 20 (shown here offset to the "left" of the shaft centerline). Depending upon the positioning of the lower grip portion's "offset" relative to the shaft 20 and the club head 32, the amount of rotational compensation (with respect to the club head and/or club face) can be adjusted to meet the needs of a user. For example, but without limitation, a purely forward or "left" offset (relative to the front of putter head 34), as shown, can serve to reduce some of the rotational impact upon the face 36 of the putter head 32 that is exerted by the rotation of the lower grip portion 18 (relative to that exerted by the upper grip portion 16). However, it is important to note that this is only one of may possible offsets that can be customized or tailored (using anything from simple observation to complex assessments and statistical computations) to address various propensities of the user with respect to the directional alignment of the putter head 36 to a ball (not shown).

Although certain preferred embodiments of the present invention have been described, the invention is not limited to the illustrations described and shown herein, which are deemed to be merely illustrative of the best modes of carrying out the invention. A person of ordinary skill in the art will realize that certain modifications and variations will come within the teachings of this invention and that such variations and modifications are within its spirit and the scope as defined by the claims.

What is claimed is:

1. A golf club grip comprising:

a shaft, including an upper shaft portion;

an upper grip portion positioned about at least a portion of the upper shaft portion of the shaft; and a lower grip portion positioned about the shaft below the upper grip portion; wherein the outer diameter of the upper grip portion is less than or equal to about 0.5714 times the outer diameter of the lower grip portion wherein the upper grip portion and the lower grip portion are separated along the shaft by a gap where no grip exists and the gap is about 1.5 inches.

2. A golf club grip as recited in claim 1, wherein the upper grip portion includes a tapered portion.

3. A golf club grip as recited in claim 2, wherein the upper grip portion includes a tapered portion that tapes from an outer diameter of about one inch to an outer diameter of about ¾ inch.

4. A golf club grip as recited in claim 1, wherein the upper grip portion has a length, the lower grip portion has a length, and the length of the lower grip portion and the length of the upper grip portion are approximately equal.

5. A golf club grip as recited in claim 1, wherein the upper grip portion has a length, the lower grip portion has a length, and the length of the lower grip portion is at least two times the length of the upper grip portion.

6. A golf club grip as recited in claim 1, wherein the outer diameter of the lower grip portion is within the range of about 1.5 inches to about 3 inches.

7. A golf club grip as recited in claim 1, wherein the upper grip portion has an outer diameter of about an inch and the lower grip portion has an outer diameter that is equal to or greater than 1.75 inches.

8. A golf club grip as recited in claim 1, wherein the average diameter of the lower grip portion is at least twice the average diameter of the upper grip portion.

9. A golf club grip as recited in claim 1, wherein the minimum outer diameter of the lower grip portion is at least ¾ of an inch larger than the largest outer diameter of the upper grip portion.

10. A golf club grip as recited in claim 1, wherein the lower grip portion includes a tapered portion.

11. A golf club grip as recited in claim 10, wherein both the upper grip portion and the lower grip portion include tapered portions.

12. A golf club grip as recited in claim 1, wherein the upper grip portion is comprised of at least two component materials.

13. A golf club grip as recited in claim 12, wherein the component materials include an outer contact material and an inner filler material adjacent the shaft.

14. A golf club grip as recited in claim 1, wherein the upper grip portion is comprise of a material that facilitates gripping by a user.

15. A golf club grip comprising:

a shaft, including an upper shaft portion;

an upper grip portion comprised of at least two material components and having a length, the upper grip portion being positioned about at least a portion of the upper shaft portion of the shaft; and a lower grip portion having a length, the lower grip portion being positioned about the shaft below the upper grip portion;

wherein the outer diameter of the lower grip portion is at least one-half inch greater than the outer diameter of the outer diameter of the upper grip portion; the upper grip portion and the lower grip portions are separated along the shaft by a gap; the length of the lower grip portion is at least two times the length of the upper grip portion; and the outer diameter of the lower grip portion is within the range of about 1.5 inches to about 3 inches.

16. A golf club grip as recited in claim 15, wherein the average outer diameter of the upper portion is less than or equal to about 0.5714 times the average outer diameter of the lower grip portion.

17. A golf club as recited in claim 16, wherein the lower grip is positioned off-center relative to the shaft.

18. A golf club comprising:

a shaft, including an upper shaft portion;

an upper grip portion positioned about at least a portion of the upper shaft portion of the shaft;

a lower grip portion positioned about the shaft below the upper grip portion; and a club head connected to the shaft;

wherein the outer diameter of the lower grip portion is at least ¾ inch greater than the outer diameter of the upper grip portion wherein the upper grip portion and the lower grip portion are separated along the shaft by a gap where no grip exists and the upper and lower grip portions are about the same shaft.

19. A golf club grip comprising:

a shaft, including an upper shaft portion;

an upper grip portion positioned about at least a portion of the upper shaft portion of the shaft;

a lower grip portion positioned about the shaft below the upper grip portion; and wherein the outer diameter of the upper grip portion is less than or equal to about 0.5714 times the outer diameter of the lower grip portion wherein the upper grip portion and the lower grip portions are separated along the shaft by a gap where no grip exists and the upper and lower grip portions are about the same shaft.

* * * * *

UNITED STATES PATENT AND TRADEMARK OFFICE

CERTIFICATE OF CORRECTION

PATENT NO. : 6,817,956 B1
DATED : November 16, 2004
INVENTOR(S) : Kim J. Dagenais It is certified that error appears in the above-identified patent and that said Letters Patent is hereby corrected as shown below:

Column 4,
Line 35, please delete “tapes” and insert -- tapers --.

Signed and Sealed this

First Day of March, 2005

JON W. DUDAS
*Director of the United States Patent and Trademark Office*